United States Patent [19]

Sakurai

[11] Patent Number: 4,596,032

[45] Date of Patent: Jun. 17, 1986

[54] ELECTRONIC EQUIPMENT WITH TIME-BASED CORRECTION MEANS THAT MAINTAINS THE FREQUENCY OF THE CORRECTED SIGNAL SUBSTANTIALLY UNCHANGED

[75] Inventor: Atsushi Sakurai, Yokohama, Japan

[73] Assignee: Canon Kabushiki Kaisha, Tokyo, Japan

[21] Appl. No.: 447,966

[22] Filed: Dec. 8, 1982

[30] Foreign Application Priority Data

Dec. 14, 1981 [JP] Japan ..... 56-201127

[51] Int. Cl.[4] ..... G10L 1/00

[52] U.S. Cl. ..... 381/51; 84/1.01; 364/513.5; 360/8

[58] Field of Search ..... 381/51, 52, 53, 41–50; 84/1.01, 1.19, 1.24, 470, 470 R; 360/8, 91; 369/84, 4

[56] References Cited

U.S. PATENT DOCUMENTS

| | | | |
|---|---|---|---|
| 3,634,596 | 1/1972 | Rupert | 84/470 |
| 3,919,913 | 11/1975 | Shrader | 84/470 |
| 4,318,188 | 2/1982 | Hoffmann | 381/51 |
| 4,321,853 | 3/1982 | Tumblin | 84/470 |
| 4,435,832 | 3/1984 | Asada et al. | 381/34 |
| 4,439,161 | 3/1984 | Wiggins et al. | 381/51 |

FOREIGN PATENT DOCUMENTS

| | | | |
|---|---|---|---|
| 55-40445 | 3/1980 | Japan | 369/4 |

*Primary Examiner*—E. S. Matt Kemeny

*Attorney, Agent, or Firm*—Fitzpatrick, Cella, Harper & Scinto

[57] ABSTRACT

Speech and melody information are separately inputted and stored. The speech timing is modified (corrected) to alignment with the melody.

13 Claims, 13 Drawing Figures

FIG. 2

| KEY | CLASS | FUNCTION |
|---|---|---|
| A | LETTER NAME KEYS | LETTER NAME "A" |
| B | | LETTER NAME "B" |
| C | | LETTER NAME "C" |
| D | | LETTER NAME "D" |
| E | | LETTER NAME "E" |
| F | | LETTER NAME "F" |
| G | | LETTER NAME "G" |
| 1 | NOTE KEYS | HEMIDEMI-SEMIQUAVER(A SIXTY-FOURTH NOTE) |
| 2 | | DEMI-SEMIQUAVER(A THIRTY-SECOND NOTE) |
| 3 | | SEMIQUAVER(A SIXTEENTH NOTE) |
| 4 | | QUAVER(AN EIGHTH NOTE) |
| 5 | | CROTCHET(A QUARTER NOTE) |
| 6 | | MINIM(A HALF NOTE) |
| 7 | | WHOLE NOTE |
| 8 | | DOUBLE WHOLE NOTE |
| 9 | | QUAD-WHOLE NOTE |
| 0 | AUX. KEYS | NUMERAL 0 |
| • | | DOTTED NOTE |
| # | | SHARP |
| b | | FLAT |
| ↑ | | SHIFT TO UPPER OCTACHORD |
| ↓ | | SHIFT TO LOWER OCTACHORD |
| - | | REST |
| Tem | CONTROL KEYS | SET TEMPO |
| Set | | SET STEP |
| Mel | | INPUT MELODY INFORMATION/START TO PLAY MELODY |
| Voi | | INPUT VOCAL INFORMATION/START TO PLAY VOCAL SOUND |
| CM | | CLEAR ENTIRE MELODY INFORMATION |
| CV | | CLEAR ENTIRE VOCAL INFORMATION |
| CL | | CORRECT INPUT/STOP TO PLAY |

FIG. 6

| STEP | DISPLAY | INPUT |
|---|---|---|
| 1 | 1 | [C] [5] [Mel] |
| 2 | 2 | [C] [5] [Mel] |
| 3 | 3 | [C] [5] [Mel] |
| 4 | 4 | [E] [5] [.] [Mel] |
| 5 | 5 | [D] [4] [Mel] |
| 6 | 6 | [C] [5] [Mel] |
| 7 | 7 | [E] [5] [Mel] |
| 8 | 8 | [E] [5] [Mel] |
| 9 | 9 | [E] [5] [Mel] |
| 10 | 10 | [G] [5] [.] [Mel] |
| 11 | 11 | [F] [4] [Mel] |
| 12 | 12 | [E] [5] [Mel] |
| 13 | 13 | [1] [Set] |
| 14 | 1 C 5 | [Voi] "î" |
| 15 | 2 C 5 | [Voi] "tsû" |
| 16 | 3 C 5 | [Voi] "mo" |
| 17 | 4 E 5. | [Voi] "î" |
| 18 | 5 D 4 | [Voi] "tsû" |
| 19 | 6 C 5 | [Voi] "mo" |
| 20 | 7 E 5 | [Voi] "tô" |
| 21 | 8 E 5 | [Voi] "ô" |
| 22 | 9 E 5 | [Voi] "rû" |
| 23 | 10 G 5. | [Voi] "yô" |
| 24 | 11 F 4 | [Voi] "gî" |
| 25 | 12 E 5 | [Voi] "sha" |

FIG. 7

(a)

| ADDRESS | DATA |
|---|---|
| 0 0 0 | ♭ 0 |
| 0 0 1 | C 5 |
| 0 0 2 | C 5 |
| 0 0 3 | C 5 |
| 0 0 4 | E 5. |
| 0 0 5 | D 4 |
| 0 0 6 | C 5 |
| 0 0 7 | E 5 |
| 0 0 8 | E 5 |
| 0 0 9 | E 5 |
| 0 1 0 | G 5. |
| 0 1 1 | F 4 |
| 0 1 2 | E 5 |
| 0 1 3 | 0 |
| 0 1 4 | 0 |
| | 0 |

(b)

| ADDRESS | DATA |
|---|---|
| 0 0 1 | i |
| 0 0 2 | tsu |
| 0 0 3 | mo |
| 0 0 4 | i |
| 0 0 5 | tsu |
| 0 0 6 | mo |
| 0 0 7 | to |
| 0 0 8 | o |
| 0 0 9 | ru |
| 0 1 0 | yo |
| 0 1 1 | gi |
| 0 1 2 | sha |
| 0 1 3 | 0 |
| 0 1 4 | 0 |

(c)

| ADDRESS | DATA |
|---|---|
| 0 0 0 | 1 0 0 |
| 0 0 1 | C 5 |
| 0 0 2 | C 5 |
| 0 0 3 | C 5 |
| 0 0 4 | E 5. |
| 0 0 5 | D 4 |
| 0 0 6 | C 5 |
| 0 0 7 | C 5 |
| 0 0 8 | C 5 |
| 0 0 9 | C 5 |
| 0 1 0 | E 5. |
| 0 1 1 | D 4 |
| 0 1 2 | C 5 |
| 0 1 3 | 0 |
| 0 1 4 | 0 |

FIG. 8

| | DISPLAY | VOCAL OUTPUT | INPUT |
|---|---|---|---|
| 1 | 1 C 5 | " î " | [1] [0] [0] [Tem] |
| 2 | 1 C 5 | " tsû " | [7] [Set] |
| 3 | 7 E 5 | " tô " | [C] [5] [Mel] |
| 4 | 8 E 5 | " ô " | [C] [5] [Mel] |
| 5 | 9 E 5 | " ru " | [C] [5] [Mel] |
| 6 | 10 G 5. | " yô | [E] [5] [.] [Mel] |
| 7 | 11 F 4 | " gî " | [D] [4] [Mel] |
| 8 | 12 E 5 | " sha " | [C] [5] [Mel] |

ELECTRONIC EQUIPMENT WITH TIME-BASED CORRECTION MEANS THAT MAINTAINS THE FREQUENCY OF THE CORRECTED SIGNAL SUBSTANTIALLY UNCHANGED

BACKGROUND OF THE INVENTION

1. Field of the Invention

The present invention relates to electronic equipment, and more particularly to electronic equipment capable of inputting and outputting melody information as well as vocal information corresponding to note information.

2. Description of the Prior Art

An electronic composing machine which stores notes in a memory in the form of intervals and time durations, and expresses the stored notes by means of a synthesizer in terms of monotonies to automatically play music, has been known. However, for vocal music, a listener encounters difficulty in matching the music to a text because only a melody is played.

SUMMARY OF THE INVENTION

It is an object of the present invention to provide an electronic equipment capable of playing melody information as well as vocal information by storing the molody information as well as the vocal information in a memory in the form of parameters.

It is another object of the present invention to provide an electronic equipment capable of producing vocal information corrected with respect to interval and time, while maintaining the frequency of the vocal information substantially unchanged, in accordance with melody information.

It is another object of the present invention to provide an electronic equipment capable of producing melody information or vocal information in accordance with the melody information, as required.

BRIEF DESCRIPTION OF THE DRAWINGS

FIG. 2 illustrates functions of all keys on a keyboard, FIG. 6 shows a music inputting procedure, FIG. 7 shows a melody data and a vocal data stored in a memory, FIG. 8 shows a correction procedure.

DETAILED DESCRIPTION OF THE PREFERRED EMBODIMENTS

One embodiment of the present invention is now explained with reference to the drawings.

Figure 1:
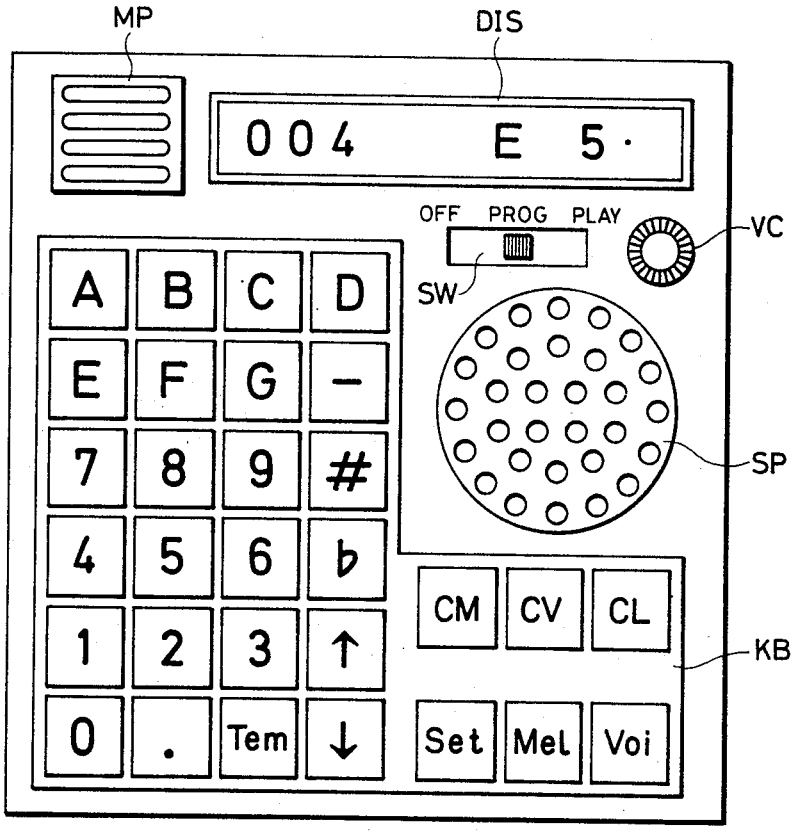
FIG. 1 shows an external view of one embodiment of an electronic composing machine with vocal sound in accordance with the present invention.

FIG. 1 shows an external view of one embodiment of the electronic composing machine with vocal sound in accordance with the present invention, in which MP denotes a voice input microphone, DIS denotes a display, SW denotes a power switch/mode selection switch, VC denotes a volume control knob for a speaker SP, SP denotes an output speaker for monotony or vocal sound, and KB denotes a keyboard.

FIG. 2 illustrates functions of the keyboard KB shown in FIG. 1. It has letter name keys A, B, C, D, E, F and G, note/step keys 1, 2, 3, 4, 5, 6, 7, 8 and 9, and auxiliary keys 0, •, #, ♭, ↑, ↓ and - to represent melody information, and control keys Tem, Set, Mel, Voi, CM, CV and CL to control the functions.

The mode selection switch SW shown in FIG. 1 is a three-position switch to represent three modes "OFF", "PROG" and "PLAY". In the "OFF" mode, the power is off, in the "PROG" mode, the melody/vocal information is inputted and corrected, and in the "PLAY" mode, monotonies or vocal sound is automatically played.

Figure 3:
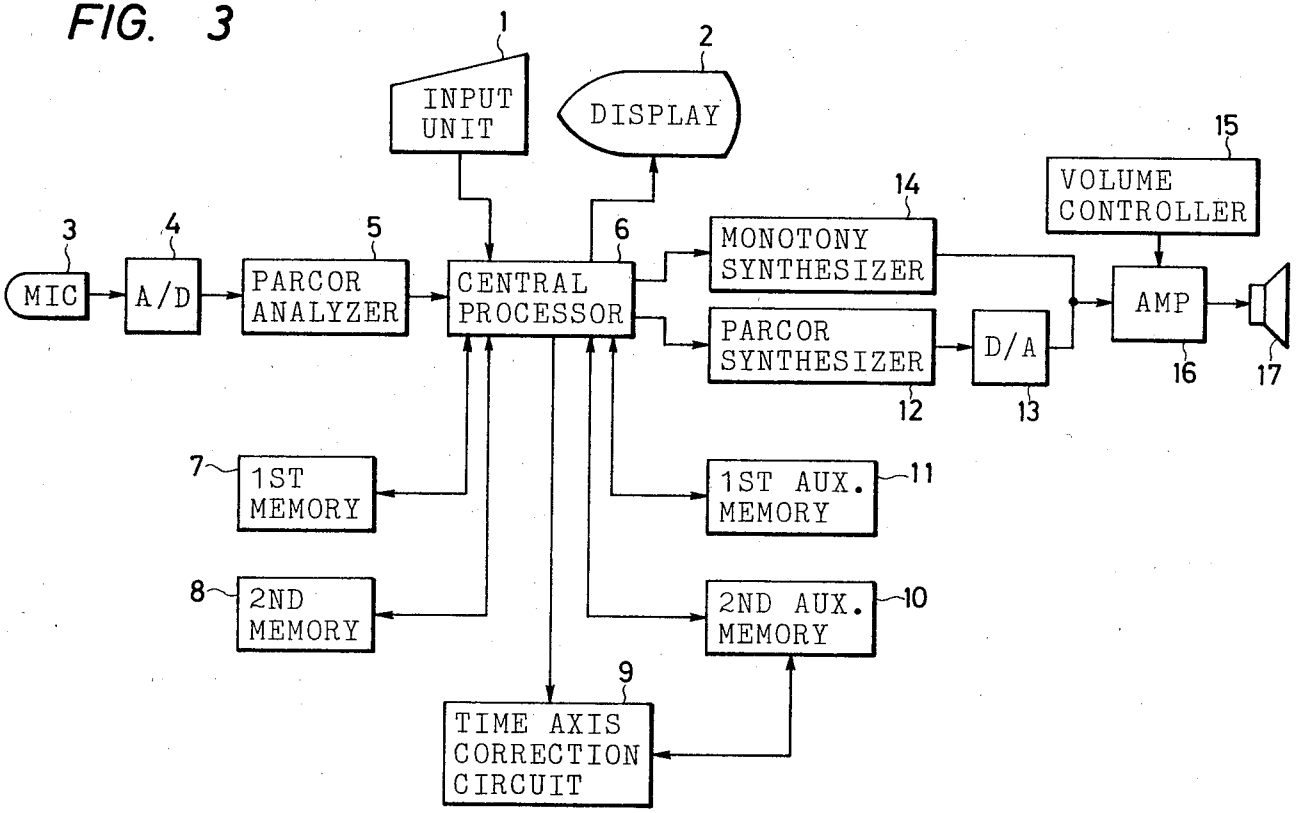
FIG. 3 shows a block diagram of a configuration of the electronic composing machine with vocal sound shown in FIG. 1.
Figure 4:
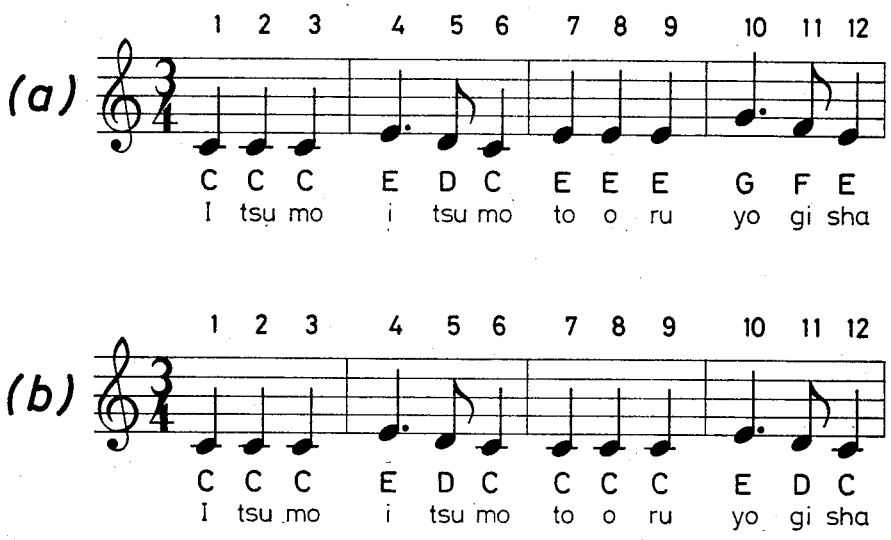
FIG. 4 shows an example of a music sheet and a step.

FIG. 3 shows a block diagram of the electronic composing machine with vocal sound shown in FIG. 1, in which numeral 1 denotes an input unit (corresponding to KB in FIG. 1), numeral 2 denotes a display (corresponding to DIS in FIG. 1), numeral 3 denotes a microphone for inputting voice (corresponding to MP in FIG. 1), numeral 4 denotes an analog-to-digital converter for converting vocal information to digital information, numeral 5 denotes a parcor analyzer for parametering the vocal information digitized by the analog-to-digital converter, numeral 6 denotes a central processor for controlling the entire equipment, numeral 7 denotes a first memory for storing the melody information, numeral 8 denotes a second memory for storing the vocal information parametered by the parcor analyzer 5, numeral 9 denotes a time axis correction circuit for normalizing the vocal parameters stored in the second memory 8, numeral 10 denotes a second auxiliary memory for storing the vocal parameters normalized by the time axis correction circuit 9 and temporarily storing data inputted by the input unit 1, numeral 11 denotes a first auxiliary memory for storing step information assigned, in an ascending order, to notes and rests of a music sheet corresponding to the melody information shown in FIG. 4, numeral 12 denotes a parcor synthesizer for synthesizing a voice signal in accordance with the normalized vocal parameters stored in the second auxiliary memory 10, numeral 13 denotes a digital-to-analog converter for analog-converting the voice signal, synthesized by the parcor synthesizer 12, numeral 16 denotes an amplifier for amplifying the analog-converted voice signal, numeral 17 denotes a speaker (corresponding to SP in FIG. 1) for converting the voice signal amplified by the amplifier 16, numeral 15 denotes a volume controller (corresponding to VC in FIG. 1) for controlling volume of sound from the speaker 17 and numeral 14 denotes a monotony synthesizer for synthesizing monotonies from the melody information stored in the first memory 7.

Figure 10:
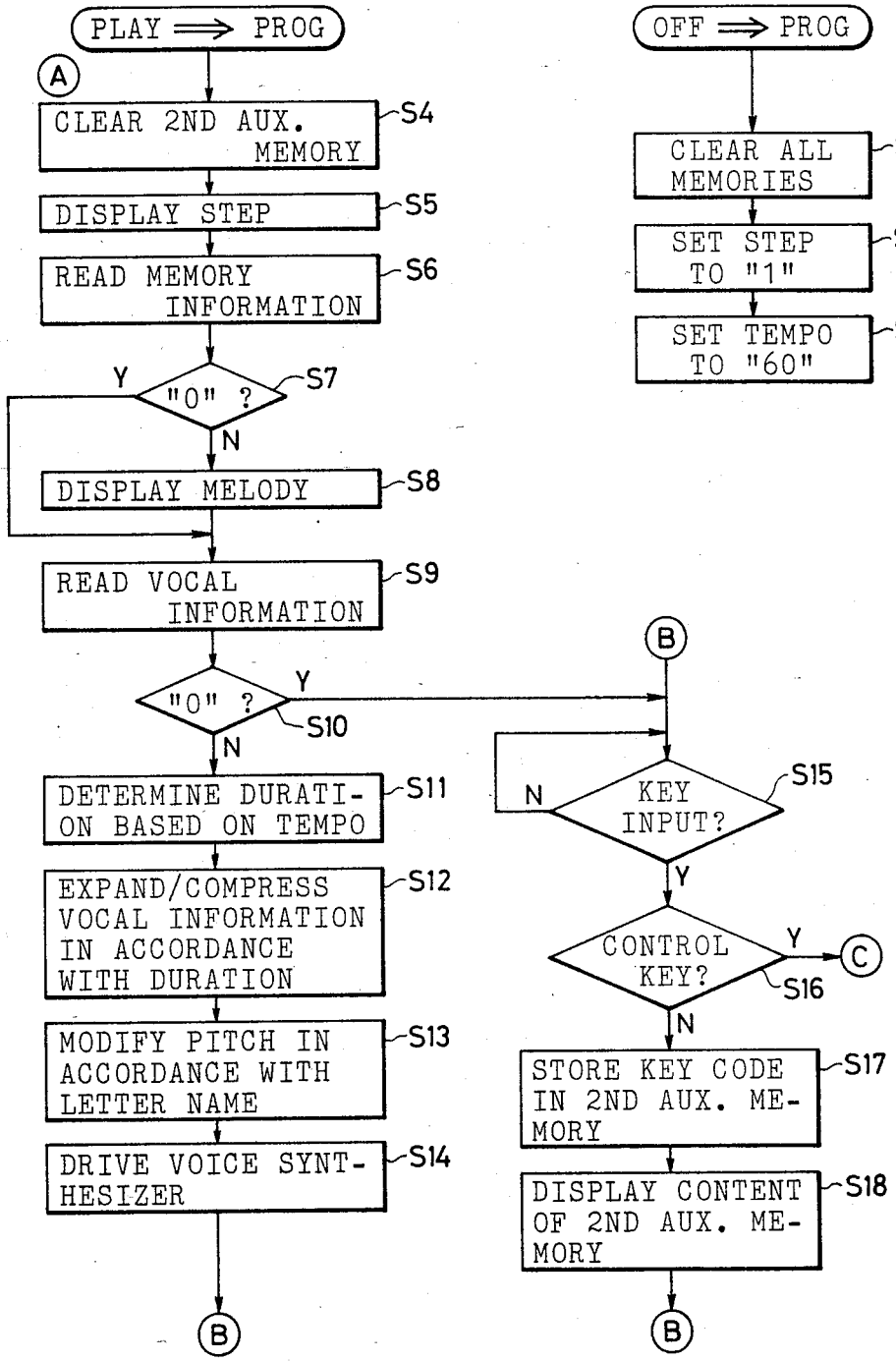
FIGS. 9 to 13 show flow charts for explaining mode selection operations.
Figure 9:
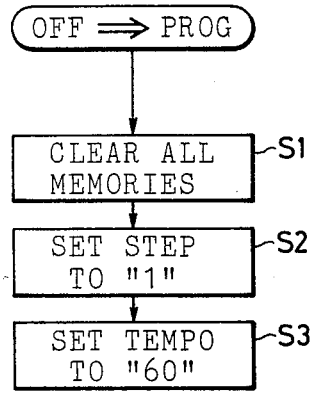

When the mode selection switch SW is switched from the "OFF" position to the "PROG" position, the central processor 6 initially clears all of the memories as shown in a flow chart of FIG. 9, stores standard tempo information (60) at an address 000 of the first memory 7 and stores step information (1) in the first auxiliary memory (S1→S2→S3). Then, melody information and vocal information are entered by keying the input unit 1. Referring to a flow chart of FIG. 10, the operation when the mode selection switch SW has been switched from the "PLAY" position to the "PROG" position in order to correct the melody/vocal information produced in the "PLAY" mode is explained.

The mode selection switch SW of the input unit 1 is switched to the "PROG" position in order to correct the melody/vocal information produced in the "PLAY" mode. The input unit 1 issues a "PROG" mode command signal to the central processor 6. The central processor 6 first clears the second auxiliary memory 10 (S4). Then, the central processor 6 reads out the step information stored in the first auxiliary memory 11 and displays it on the display 2 by decimal numbers (S5). The step information comprises integers ranging from 1 to 999. As shown in a score of FIG. 4(*a*), the notes and the rests of the score are numbered in an ascending order with a first note or rest of the music sheet being assigned with the number 1.

The central processor 6 then reads out the melody information stored at the addresses of the first memory 7 corresponding to the addresses of the step information and displays it on the display 2 (S6→S7→S8). The melody information is displayed adjacent to the step information.

Figure 5:
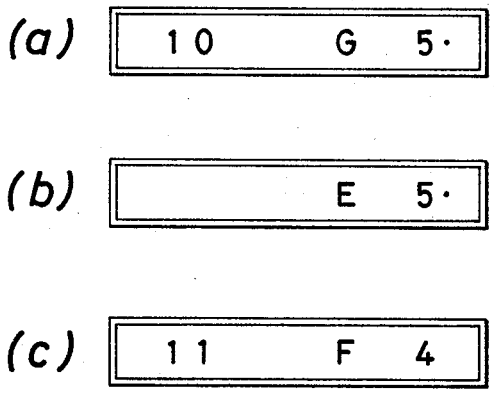
FIG. 5 shows various displays.

Assuming that the data in the first auxiliary memory 11 is "10" and the melody information shown in FIG. 4(*a*) is stored in the first memory 7, the step information 10 represents a dotted crotchet with a letter name "G" as seen from FIG. 4(*a*) and the display 2 displays as shown in FIG. 5(*a*). The step information 11 represents a quaver with a letter name "F" and the display 2 displays as shown in FIG. 5(*c*).

The central processor 6 reads out the vocal parameters stored at the addresses of the second memory 8 corresponding to the addresses of the step information, adds to them sound source frequency signal information determined based on the melody information, stores the combined information in the second auxiliary memory 10, then determines the durations of the vocal sound from the notes in the melody information and the tempo information stored at the address 000 of the first memory 7, and expands or compresses the time axis by the time axis correction circuit 9 (S9→S10→S11→S12).

The time axis correction circuit 9 expands or compresses the data along the time axis without changing the frequency thereof.

The central processor 6 then determines pitches or tones of the vocal parameters corrected for time axis, based on the note information stored in the first memory 7 and sends them to the parcor synthesizer 12 (S13→S14). The vocal parameters are voice-synthesized by the parcor synthesizer 12 and the output signal therefrom is supplied to the A/D converter 13, the amplifier 16 and the speaker 17. The volume of the sound output is controlled by the volume controller 15.

When the vocal parameter is not stored at the corresponding address of the second memory 8, the voice sound is not produced.

When the melody information is not stored at the corresponding address of the first memory 7, only the step information is displayed.

After the series of operations described above, the central processor 6 waits for the data from the input unit 1.

The operation of the central processor 6 when the key data is entered is classified into the following two operations.

In the first operation, when the key data belonging to the classes "LETTER NAME", "NOTE" or "AUX." shown in FIG. 2 is inputted, the key code is stored in the second auxiliary memory 10 and the content thereof is displayed on the display 2 (S15→S16→S17→S18).

Figure 11:
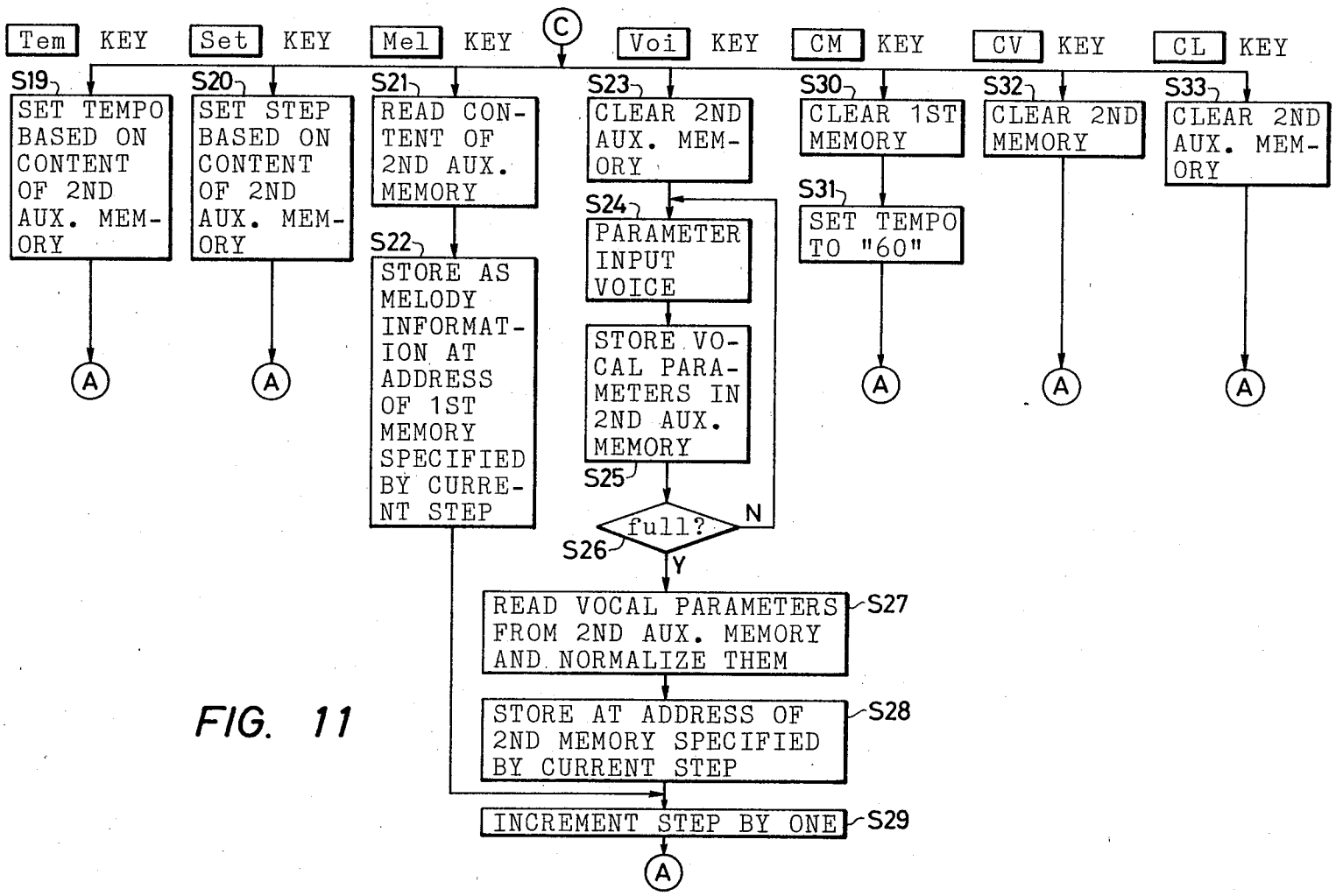

In the second operation, when the key data belonging to the class "CONTROL" shown in FIG. 2 is inputted, a control operation as shown in a flow chart of FIG. 11 is carried out based on the data stored in the second auxiliary memory 10.

(1) In response to Tem key input, tempo information is stored at a start address of the first memory 7 based on the data stored in the second auxiliary memory 10 (S19).

(2) In response to Set key input, step information is stored in the first auxiliary memory 11 based on the data stored in the second auxiliary memory 10 (S20).

(3) In response to Mel key input, melody information is stored at the addresses of the first memory 7 corresponding to the addresses of the step information stored in the first auxiliary memory 11 based on the data stored in the second auxiliary memory 10, and the step information in the first auxiliary memory 11 is incremented by one (S21→S22→S29).

(4) In response to Voi key input, the content of the second auxiliary memory 10 is cleared and the voice input from the microphone 3 is supplied to the A/D converter 4 and the parcor analyzer 5 to produce vocal parameters, which are sequentially stored in the second auxiliary memory 10 (S24→S25). This operation is continued until vacant areas of the second auxiliary memory have been exhausted (S26). After the above operation, the vocal information stored in the second auxiliary memory 10 is normalized by the time axis correction circuit 9 (S27). The vocal parameters are normalized to a fixed length. The normalized vocal parameters are read out from the second auxiliary memory 10 and stored at the addresses of the second memory 8 corresponding to the addresses of the step information stored in the first auxiliary memory 11 (S28). Finally, the content of the first auxiliary memory 11 is incremented by one (S29).

(5) In response to CM key input, the content of the first memory 7 is cleared. The data (60) is stored at the start address 000 (S30→S31).

(6) In response to CV key input, the content of the second memory 8 is cleared (S32).

(7) In response to CL key input, the content of the second auxiliary memory 10 is cleared (S33).

The input correction operation in the "PROG" mode is explained by way of example. If the keys E , 5 , • are depressed when the display 2 displays as shown in FIG. 5(*a*), codes E , 5 , • are stored in the second auxiliary memory 10 and the display 2 now displays as shown in FIG. 5(*b*). If the key Mel is then depressed, the melody information E , 5 , • is read from the second auxiliary memory 10 and it is stored at the address 10 of the first memory 7 so that the correction is mode. Then, the content of the first auxiliary memory 11 is incremented by one and the display 2 now displays the step information "11" and the melody information "F4".

Figure 12:
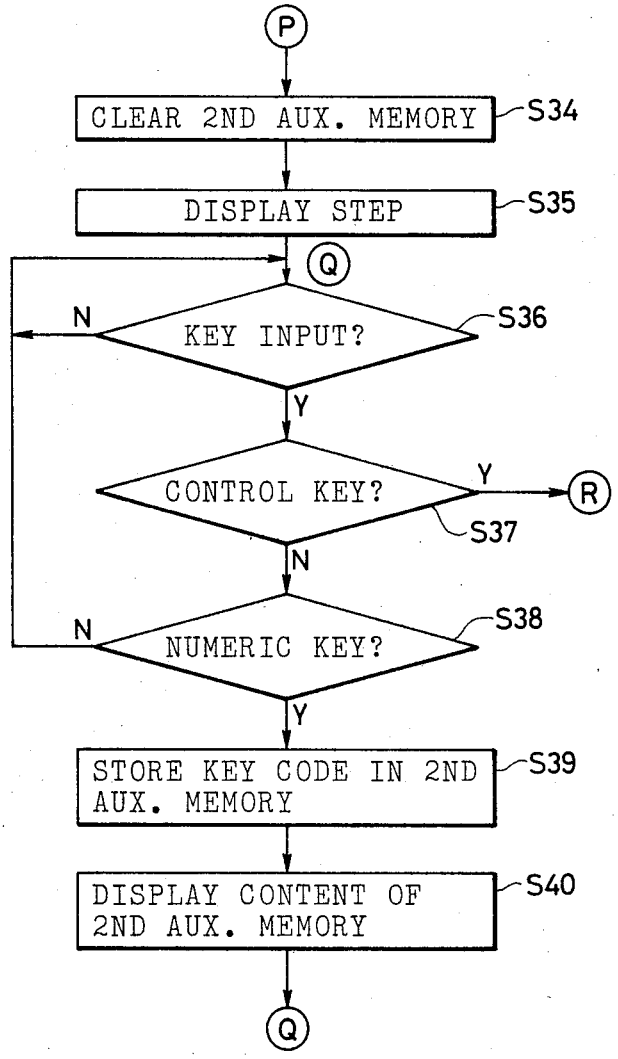

The operation when the mode selection switch SW of the input unit 1 has been switched to the "PLAY" position is now explained with reference to a flow chart of FIG. 12. When the mode selection switch SW of the input unit 1 is switched from the "PROG" position to the "PLAY" position, the keyboard 1 issues a "PLAY" mode command signal to the central processor 6. The central processor first clears the second auxiliary memory 10. Then, the central processor 6 reads out the step information stored in the first auxiliary memory 11 and displays it on the display 2 by decimal numbers (S35).

Then, the central processor 6 waits for the data from the input unit 1.

The operation of the central processor 6 when the key data is inputted is classified into the following two operations.

In the first operation, when the key data belonging to the class "LETTER NAME", "NOTE" or "AUX." shown in FIG. 2 is inputted, the key code is stored in the second auxiliary memory 10 and the content of the second auxiliary memory 10 is displayed on the display 2 (S36→S37→S38→S39→S40).

Figure 13:
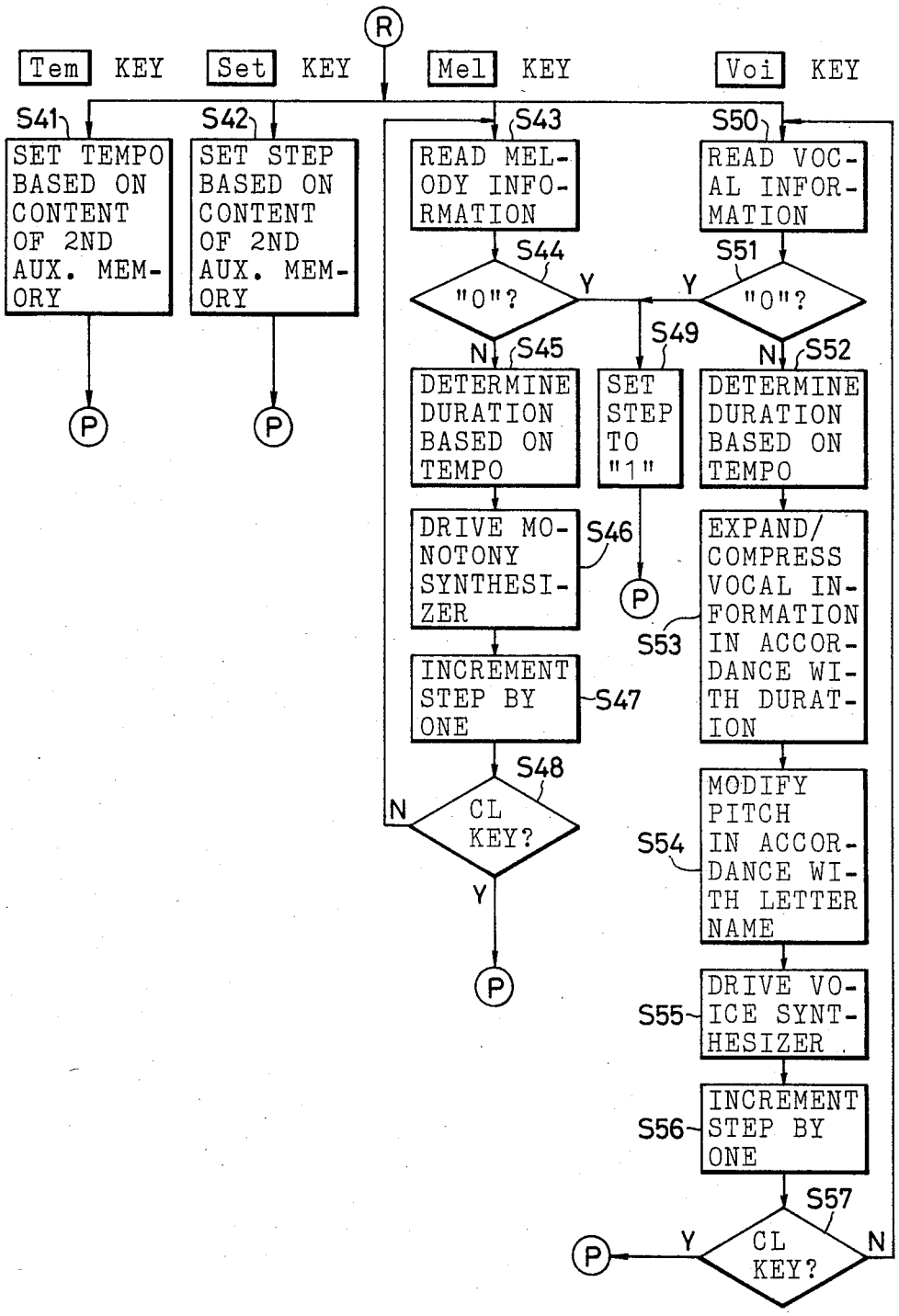

In the second operation, when the key data belonging to the class "CONTROL" of FIG. 2 is inputted, the central processor 6 carries out control operations in response to the following five control keys in a manner shown in a flow chart of FIG. 13.

(1) In response to Tem key input, the tempo data is stored at the address 000 of the first memory 7 (S41).

(2) In response to Set key input, the step information is stored in the first auxiliary memory 11 (S42).

(3) In response to Mel key input, the melody information is read out from the address of the first memory 7 specified by the step information stored in the first auxiliary memory 11 and it is supplied to the monotony synthesizer 14. The melody information is converted to a monotony by the monotony synthesizer 14 and the converted signal is supplied to the amplifier 16 and the speaker 17. The content of the first auxiliary memory 11 is incremented by one, and the above operation is repeated until the melody information read from the first memory 7 reaches zero (S43→S44→S45→S46→S47→S48). "1" is set in the first auxiliary memory 11. Thus, the monotony output operation is completed (S43→S44→S49).

(4) In response to Voi key input, the same operation as (3) is repeated for the vocal data stored in the second memory 8 to produce voice output. The time axis correction circuit 9, the second auxiliary memory 10, the first auxiliary 11, the parcor synthesizer 12 and the D/A converter 13 are used as are used in producing the voice output in the "PROG" mode (S50→S51→S52→S53 S54→S55→S56→S57). The content of the first auxiliary memory 11 is incremented by one and the voice output operation is completed (S50→S51→S49).

(5) In response to CL key input, the monotony or voice output operation is stopped and "1" is set in the first auxiliary memory 11.

Finally, a procedure for inputting and playing the music sheets (*a*) and (*b*) of FIG. 4 by the "PROG" mode and the "PLAY" mode is explained.

When the mode selection switch SW is switched from the "OFF" position to the "PROG" position, the "PROG" mode is established. The first memory 7 and the second memory 8 are initially cleared and the standard tempo information (60) is stored at the address 000 of the first memory 7, and "1" is set in the first auxiliary memory 11.

Starting from this condition, the music sheet of FIG. 4(*a*) is inputted in steps 1 to 25 shown in FIG. 6. In FIG. 6, respective columns show step numbers, displays when the steps are started and input data. "i" shows a voice input from the microphone MP.

Through the above steps, data shown in FIG. 7(*a*) and (*b*) are stored in the first memory 7 and the second memory 8, respectively. Thus, by switching the mode selection switch to the "PLAY" position and keying the keys 1 , Set , Mel in this sequence, the music represented by the music sheet of FIG. 4(*a*) is automatically played by monotonies at tempo 60, and by keying the keys 1 , Set , Voi in this sequence, the music is automatically played by vocal sound.

The music sheet of FIG. 4(*b*) shows a bass for the music sheet of FIG. 4(*a*). The music sheets of FIG. 4(*a*) and FIG. 4(*b*) differ in the six steps, steps 7 to 12, of the step information.

In the "PROG" mode, the tempo is set to "100" and bass data are set in the steps 7 to 12 by a procedure shown in FIG. 8. Thus, the data in the first memory 7 is changed as shown in FIG. 7(*c*).

The content of the second memory 8 is unchanged. Thus, by keying the keys 1 , Set , Mel in this sequence, the bass music represented by the music sheet of FIG. 4(*b*) is automatically played by monotonies, and by keying the keys 1 , Set , Voi in this sequence, it is played by vocal sound. If a listener sings a song in treble in harmony with the automatic play, double chorus can be played by one person. Alternatively, the treble may be automatically played by the machine and the bass may be sung by the listener.

As described hereinabove, according to the present invention, the vocal song can be readily handled by the electronic composing machine and the user of the machine can sing a desired part of the song depending on a desired tone of the user to play double chorus. Thus, the application is broadened.

While the parcor voice analyzer and synthesizer are used in the embodiment, the present invention is not limited thereto but any vocal data which can be time axis-adjusted may be used.

What I claim is:

1. Electronic equipment comprising:

memory means for storing melody information;

input means for inputting vocal information corresponding to the melody information stored in said memory means;

correction means for correcting intervals and times of the vocal information inputted by said input means, while maintaining the frequency of the vocal information substantially unchanged, by referring to the melody information; and output means for outputting the vocal information corrected by said correction means.

2. Electronic equipment according to claim 1 wherein said input means includes a microphone for inputting the vocal information and an analog-to-digital converter for digitizing the vocal information inputted by said microphone.

3. Electronic equipment according to claim 1 wherein said output means includes a digital-to-analog converter for converting the digitized vocal information into an analog voice signal and a speaker for outputting the analog voice signal.

4. Electronic equipment comprising:

first memory means for storing melody information;

second memory means for storing vocal information corresponding to the melody information stored in said first memory means;

instruction means for instructing an output of the melody information stored in said first memory means and the vocal information stored in said second memory means;

correction means for correcting intervals and times of the vocal information, while maintaining the frequency of the vocal information substantially unchanged, by referring to the melody information when said instruction means instructs the output of the vocal information; and output means for outputting the melody information and the vocal information corrected by said correction means.

5. Electronic equipment according to claim 4 further comprising input means including first input means for inputting the melody information to be stored in said first memory means and second input means for inputting the vocal information to be stored in said second memory means.

6. Electronic equipment according to claim 5 wherein said first input means includes a keyboard having a plurality of keys.

7. Electronic equipment according to claim 5 wherein said second input means includes a microphone.

8. Electronic equipment according to claim 4 wherein said output means includes a speaker.

9. Electronic equipment for storing melody information inputted by an input unit in a memory and outputting the melody information stored in said memory in response to an instruction from said input unit, comprising:

input means for inputting vocal information corresponding to the melody information;

voice analyzer means for generating voice parameters representing the vocal information inputted by said input means;

correction means for correcting intervals and times of the voice parameters representing the vocal information, while maintaining the frequency of the vocal information substantially unchanged, by referring to the melody information;

voice synthesizer means for voice-synthesizing the voice parameters corrected by said correction means; and output means for outputting the vocal information synthesized by said voice synthesizer means.

10. Electronic equipment according to claim 9 wherein said input means includes a microphone.

11. Electronic equipment according to claim 9 wherein said voice analyzer means includes a parcor analyzer.

12. Electronic equipment according to claim 9 wherein said voice synthesizer means includes a parcor synthesizer.

13. Electronic equipment according to claim 9 wherein said output means includes a speaker.

* * * * *